US005615883A

United States Patent [19]

Stevens

[11] Patent Number: 5,615,883

[45] Date of Patent: Apr. 1, 1997

[54] FIGURINE PUZZLE WITH DISPLAY APPARATUS

[76] Inventor: Denise M. Stevens, 35,000 Pacific Coast Hwy., Malibu, Calif. 90265

[21] Appl. No.: 519,794

[22] Filed: Aug. 28, 1995

[51] Int. Cl.[6] ..... A63F 9/10

[52] U.S. Cl. ..... 273/157 R

[58] Field of Search ..... 273/153 R, 156, 273/157 R; 206/315.1

[56] References Cited

U.S. PATENT DOCUMENTS

| | | | |
|---|---|---|---|
| D. 228,359 | 9/1973 | Jones | 273/157 R |
| 1,443,217 | 1/1923 | Dodd | 273/157 R |
| 2,617,654 | 11/1952 | Nolan et al. . | |
| 2,919,516 | 1/1960 | Schaefer . | |
| 3,767,203 | 10/1973 | Eaker | 273/157 R |
| 4,302,013 | 11/1981 | Kavis | 273/157 R |
| 4,479,651 | 10/1984 | LaFleur | 273/157 R |

FOREIGN PATENT DOCUMENTS

| | | | |
|---|---|---|---|
| 9104774 | 4/1991 | WIPO | 273/157 R |

OTHER PUBLICATIONS

Pictorial Price Guide to American Antiques, Dorothy Hamond, p. 153. 1867.

The Lyle Official Antique Review, pp. 98–103 and 514–515. 1995.

Bits and Pieces, "Heeps of Cats" #05–K2717 and Heeps of Pigs #05–K2719, Dec. 1995, pp. 41 and 50.

Puzzles old and New How to Make and Solve Them, Jerry Slocum, a "pentomino set" designed by Sabu Oguro, p. 40, 1986.

Better Homes and Gardens, Dec. 1976, p. 49, a "Pine Creche" by David Ashe.

Better Homes and Gardens Treasury of Christmas Crafts and Foods, 1980, "Pine Creche" by David Ashe, pp. 15 and 19.

*Primary Examiner*—Steven B. Wong

[57] ABSTRACT

A puzzle having puzzle figurines (18–38), a frame (12), a base (10), and a hinge (14). The puzzle figurines (18–38) altogether create a specific theme and can stand in a perpendicular position as figurines and can also lay in a horizontal position as puzzle pieces—altogether joining into a puzzle formation. The frame (12) is shaped specifically to correlate with the theme of puzzle figurines (18–38). The frame (12) surrounds all puzzle figurines (18–38) to hold them in their assembled position. The base (10) supports puzzle figurines (18–38) and frame (12) in their assembled position. The hinge (14) at the bottom edge of base (10) and frame (12) holds the frame (12) and the puzzle figurines (18–38) in their assembled position onto base (10). Hinge (14) also enables frame (12) to lift to a perpendicular position freeing puzzle figurines from their assembled position. The frame (12) stands alone in its perpendicular position in back of base (10) to create an appropriate background for the figurines (18–38) and along with base (10) creates an appropriate setting for the figurines in their perpendicular position. Together the base (10) frame (12), and Hinge (14) create a holding and display apparatus for puzzle figurines (18–38) in their horizontal and perpendicular positions.

1 Claim, 4 Drawing Sheets

FIGURINE PUZZLE WITH DISPLAY APPARATUS

BACKGROUND—FIELD OF INVENTION

This invention relates to puzzles, specifically to the kind that have pieces that can stand as figurines and together create a scene,

BACKGROUND—DESCRIPTION OF PRIOR ART the individual pieces of most puzzles, when taken apart, lack significance without the other pieces of the puzzle being attached. Such as U.S. Pat. No. 2,617,654 to J. J. Nolan ET AL (1952) and U.S. Pat. No. 2,919,516 to E. R. Shaefer (1960). When assembled, these puzzles become attractive figurines and toys. When disassembled, however, the individual pieces by themselves are not appealing to the eye.

*Bits and Pieces,* December 1994, pg. 41 and 50, advertised two puzzles called "Heeps of Cats" #05-K2717 and "Heeps of Pigs" #05-K2719. Although a couple pieces have their own significant shapes when apart, the remaining pieces are distorted—requiring the other pieces to be attached in order for the animals to look complete.

*Puzzles Old and New How to Make and Solve Them,* a book by Jerry Slocum and Jack Botermans, 1986, pg 40, published a pentomino set designed by Sabu Oguro. The pieces of this pentomino set are very attractive, however the pieces are put together with their geometric outline rather than with the indents of the figurines, leaving gaps and spaces between them. Therefore the shapely edges are for aesthetic appeal and decoration rather than for aiding in the solution of the puzzle.

*Better Homes and Gardens,* December 1976, pg. 49, published a project called a "Pine Crèche" by David Ashe. It was published again in *Better Homes and Gardens—Treasury of Christmas Crafts and Foods,* 1980, pg. 15 and 19. The design attempted to have all the figurines "nestle in the manger" similar to a puzzle. This design suffers from a number of disadvantages. One, it lacks the three dimensional effect of a traditional crèche. Two, the base and frame are glued together and propped up in back of the figurines thus giving it a very flat appearance and also causing it to be unstable. Third, the figurines are square and abstract having many corners that are rounded out to compromise a true puzzle formation thus making logical assemblage of the figurines very difficult.

OBJECTS AND ADVANTAGES

Accordingly, several objects and advantages of the present invention are:

- To provide a figurine puzzle having a frame that holds the figurines, conveniently releases them for handling, and alone creates an appropriate background for the figurines.
- To provide a figurine puzzle with a hinge connecting frame to base as to enable frame to accomplish these tasks.
- To provide a figurine puzzle with a base that both supports the figurines when assembled and provides a stable apparatus for the figurines to stand on when apart.
- To provide a figurine puzzle that doesn't appear flat having a very three-dimensional affect, and looks attractive from every angle.

- To provide a figurine puzzle that has minimal, yet sufficient, parts and is easy to use.
- To provide a figurine puzzle with curves and grooves in the frames inner edge that adds detail to the shape of the figurines and aids in puzzle assemblage,
- To provide a figurine puzzle that visually and intellectually appeals to all age groups.

DRAWING FIGURES

In the drawings, closely related figures and parts have the same number but have different alphabetic suffixes.

| Reference Numbers Used in Drawings | |
|---|---|
| 10 | base |
| 12 | frame |
| 14 | hinge |
| 16A-L | screws |
| 18 | Mary |
| 20 | Joseph |
| 22 | Wiseman |
| 24 | Wiseman |
| 26 | Wiseman |
| 28 | Jesus in Manger |
| 30 | camel |
| 32 | horse |
| 34 | cow |
| 36 | lamb |
| 38 | goat |

DETAILED DESCRIPTION OF PREFERRED EMBODIMENT

Figure 1A:
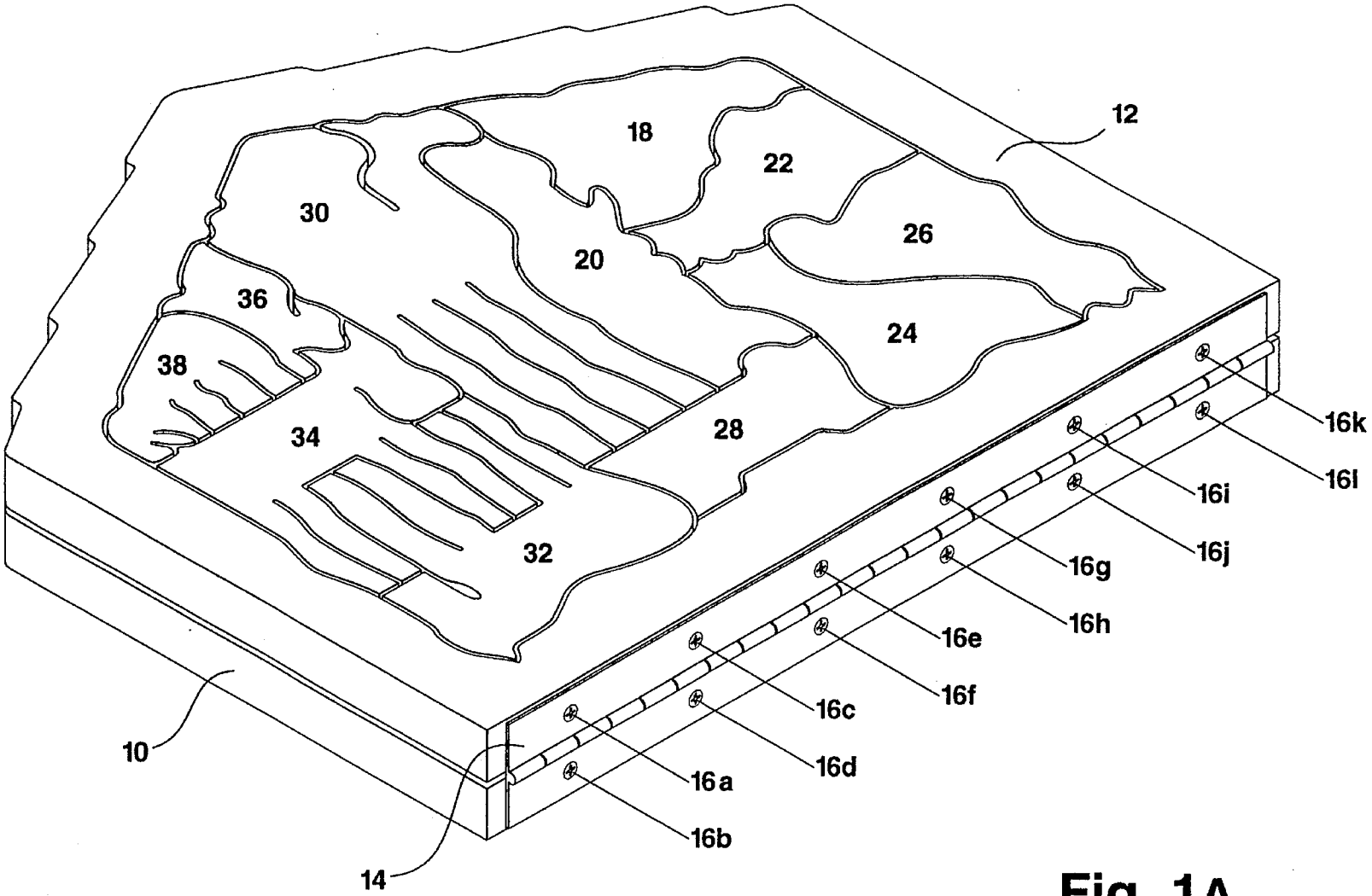
FIGS. 1A and 1B show perspective views of figurine puzzle in its assembled position.
Figure 1B:
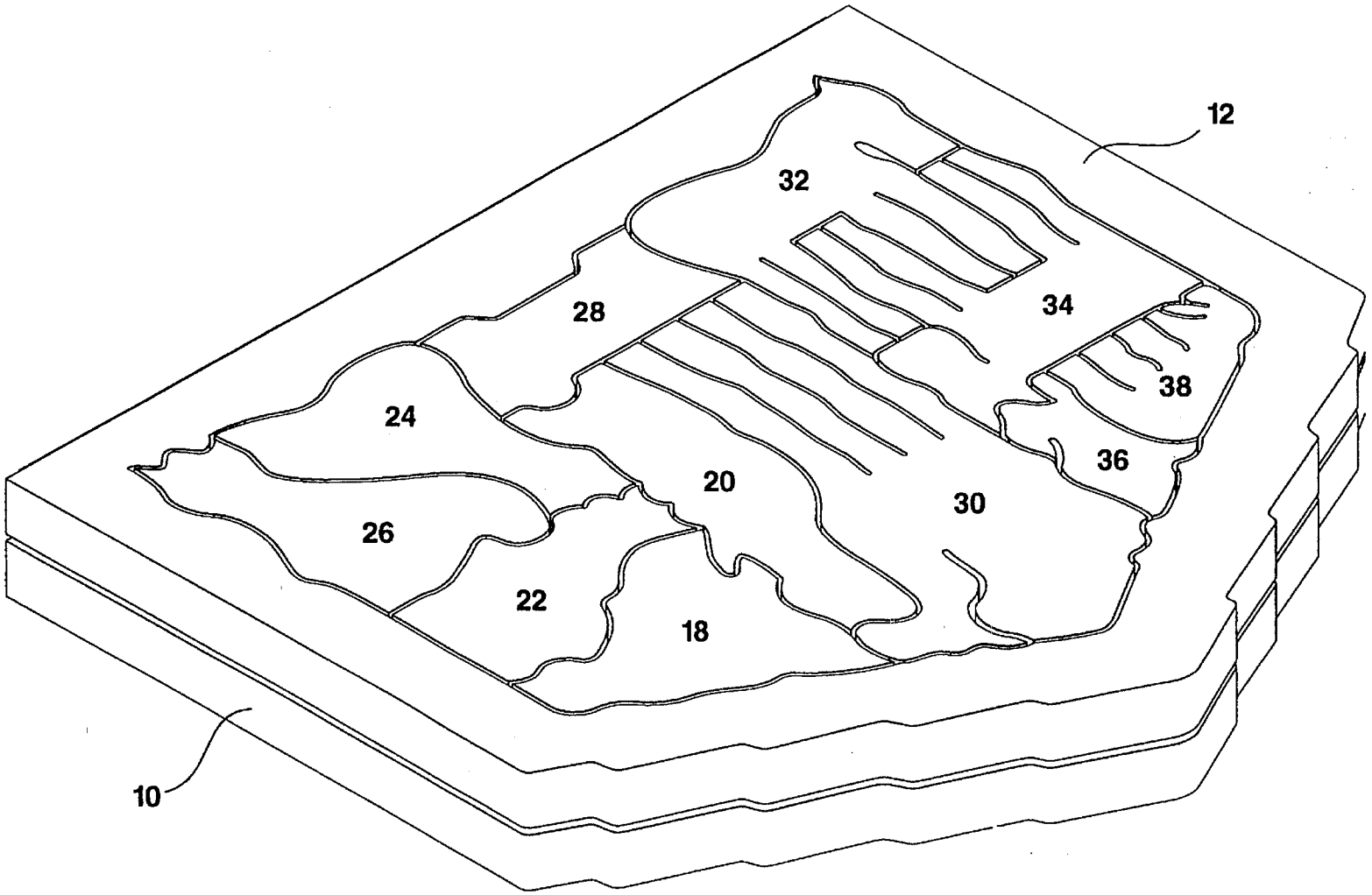

For illustrative purposes, the provided drawings show the figurine puzzle in crèche theme. In FIG. 1A and 1B, a figurine is shown in its assembled position comprising puzzle figurines 18–38 assembled as puzzle pieces inside a frame 12 that is positioned on top of a base 10 and held in place by a hinge 14 which is secured by screws 16A–L. Hinge 14 and screws 16A–L are shown only in FIG. 1A at the bottom of base 10 and frame 12.

Figure 2:
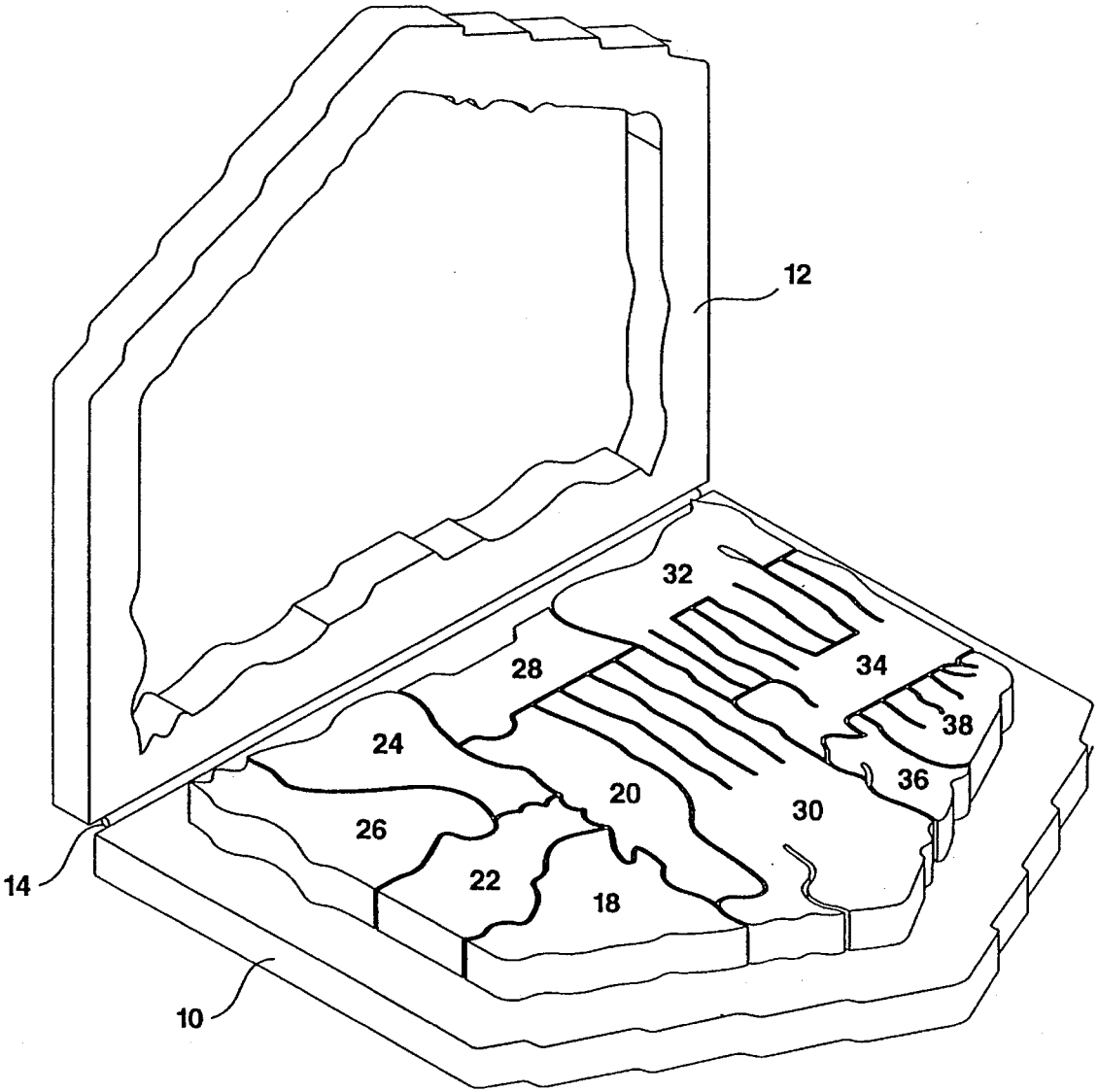
FIG. 2 shows figurine puzzle with its frame in the raised position.

All puzzle figurines 18–38 are shown in FIG. 1A, 1B, and more clearly in FIG. 2 in their horizontal position closely fitting into a puzzle formation with all edges completely abutting each other without gaps or any unused space between them. All puzzle figurines 18–38 together create a specific theme. Each puzzle figurine 18–38 takes on its own specific shape and part in this theme with each edge complimenting the other abutting edges by adding distinctive detail that is typical of the character or shape being represented, This particular embodiment includes a representation of: Mary 18, Joseph 20, the three Wisemen 22, 24, 26, Jesus in the manger 28, a camel 30, a horse 32, a cow 34, a lamb 36, and a goat 38.

Shown in FIG. 1A and 1B is a frame 12 in its horizontal position fitting perfectly around all puzzle figurines 18–38 in puzzle formation. Frame 12 has curves and grooves that can be seen more clearly in FIG. 2. Frame 12 is shaped to correlate with the theme of the puzzle figurines 18–38. This particular embodiment, having a crèche theme, has frame 12 in the shape of a stable or dwelling.

Also shown in FIG. 1A, 1B and more clearly in FIG. 2 is base 10 that is in the same shape and size of the outer edge of frame 12 and sits directly under frame 12 to support frame 12 and puzzle figurines 18–38 in their horizontal assembled position. Base 10 is connected to frame 12 by hinge 14 which is secured by screws 16A–L as shown only in FIG. 1A.

Figure 3:
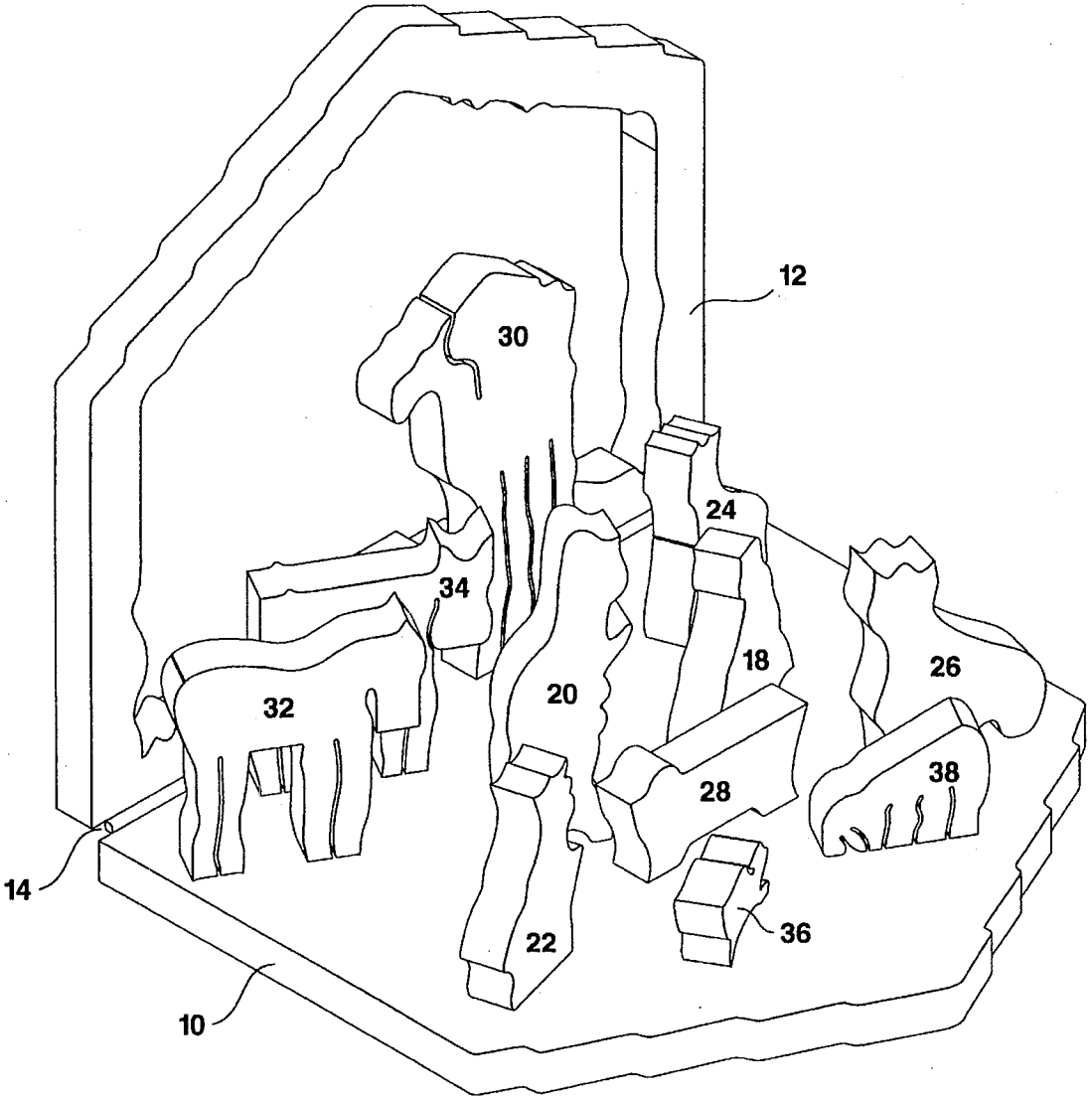
FIG. 3 shows a perspective view of figurine puzzle in its disassembled position.

Frame 12 is shown in FIG. 2 in its lifted position from base 10 and supported by hinge 14. Frame 12 alone provides an appropriate background for the figurines 18–38 creating a display apparatus for puzzle figurines 18–38 and along with base 10 creates an appropriate background for the figurines 18–38 in their perpendicular position. FIG. 3 shows puzzle figurines 18–38 standing in a perpendicular position as figurines with the detail of each figurine very visible. All animals 30–38 have shapely legs and ears, cow 37 has hip bone, horse 32 has a curved back and neck, all Wisemen 22–26 have distinctive crowns, all people 18–38 have faces, and 18,20,22,24, and 26 have flowing robes.

Presently, the preferred method of production of this puzzle is by means of a scroll saw in the following manner. The design for a figurine puzzle is drawn onto a piece of wood using a stencil or carbon paper with pattern. A small hole is drilled into an accent line within a puzzle figurine 18–38, not on any outer edges. In the crèche design, a small hole is drilled into the neck of horse 32. The blade of the scroll saw is threaded through hole wherein it is placed for cutting. Frame 12 and puzzle figurines 18–38 are then cut. Accent lines are then added to the puzzle figurines (e.g. the lines on legs of animals 30, 32, 34 and 36). Frame 12 is then placed onto another piece of wood to be traced and cut out as base 10 for an accurate fit. Puzzle figurines 18–38, frame 12, and base 10 are sanded and finished as desired. Frame 12 and base 10 are clamped together and drilled for placement of hinge 14. Hinge 14 is then paced and secured by screws 16A–L. Thickness of wood used is determined by desired height and size of puzzle as to enable puzzle figurines 18–38 to stand. If desired thickness allows, base 10, and frame 12 can be cut simultaneously. This invention is subject to various methods of production using other materials as later indicated.

From the description above, a number of advantages of my figurine puzzle with display apparatus become evident:

- The frame holds the figurines onto base, easily lifts to conveniently access the figurines, and alone provides ample background setting for the figurines all in one simple step.
- A hinge is used at bottom of base and frame to assist frame in these positionings.
- It provides a sturdy base that supports the figurines in puzzle form and displays the figurines in an appropriate setting that won't topple or fall over.
- It has a three dimensional appearance as if looking into a lifelike scene or setting and looks appealing at every angle, even from the back.
- The figurines are very distinct in shape and the curves and grooves in the inner edge of the frame help to properly place the figurines in their assembled position.
- It provides a simple design with minimal parts and the connecting hinge is not visible when frame is lifted.

The appearance of the figurines and the display apparatus is very neat and appeals to all ages

Operations—FIGS. 1–3

Illustrated in FIG. 1A and 1B is frame 12 and base 10 in their closed position creating a holding apparatus for puzzle figurines 18–38 in their assembled position. When properly placed, each puzzle figurine 18–38 creates a distinctive outline for another piece to fit thus requiring the use of hand-eye coordination.

Base 10 remains stationary onto a flat surface while frame 12 can be easily lifted from base 10 neatly freeing puzzle figurines 18–38 for handling as shown in FIG. 2. Frame 12 is supported by hinge 14 in a perpendicular position to base 10 which alone creates an appropriate setting and along with the base 10 and hinge 14 creates a display apparatus for puzzle figurines 18–38 as they sit in their perpendicular position. As shown in FIG. 3, puzzle figurine 18–38 can either: (1) be arranged on display apparatus in order to create a scene, or (2) can be played with as individual toys.

Frame 12 and base 10 may then be closed again for puzzle assemblage. As shown in FIG. 1A and 1B, the figurine puzzle can easily be put away for compact storage after it has been completely assembled.

Summary, Ramifications, and Scope

Accordingly, the reader will see that the figurine puzzle of this invention has many advantages:

- The frame accomplishes three tasks all in one simple design by holding, releasing and displaying the figurines.
- The hinge aids frame in these accomplishments.
- The base both holds the figurines and acts as a floor or ground setting for the figurines while providing stability.
- The result is a very three-dimensional appearance and looks beautiful at any perspective.
- The design is very simple and clean with minimal parts and the hinge does not show when frame is lifted.
- The curves and grooves in the inner edge of the frame along with distinctively shaped figurines makes the puzzle challenging and, at the same time, aids in the proper assemblage of the puzzle pieces while enhancing eye-hand coordination.
- The puzzle is challenging, fun, and visually appealing to people of all ages.

Although the descriptions above contain many specificity's, this invention may be embodied in other specific themes and shapes. This invention is subject to other types of manufacture such as to be cut with lasers, or molded in other materials manmade or natural. Size and thickness of the figurine puzzle may vary. Different finishes can be used such as: varnishing, painting, etching, etc. The figurines may be further cut and finished or painted and then glued back together for added detail. The hinge may be replaced by other devices that will accomplish equal results in enabling the frame to lift from base. The puzzle may be cut out and unfinished with hinge unattached to be sold at craft stores. The base and frame can have parts added to assist in securing closure. The presently preferred embodiments are therefore to be considered as illustrative rather than restrictive. Thus the scope of this invention is indicated by the appended claims and their legal equivalent, rather than by examples given.

I claim:

1. A figurine puzzle with display apparatus comprising of:

a plurality of puzzle figurines, altogether creating a specific theme, each said puzzle figurine represents a specific identifiable shape, each said puzzle figurine can stand in a perpendicular position as a figurine and can lay in a horizontal assembled position as a puzzle piece, altogether joining into a puzzle formation;

a base that lays in a horizontal position and supports said puzzle figurines in their assembled position and acts as a pedestal for said puzzle figurines to stand on in their perpendicular position; and a frame that is shaped to correlate with the theme of said puzzle figurines and lays horizontally on top of said base surrounding and holding said puzzle figurines onto said base in their assembled position, said frame can lift from said base releasing said puzzle figurines for handling, and said frame can stand in a perpendicular position behind said base alone creating an appropriate background for said puzzle figurines, said frame in its perpendicular position behind said base creates a display apparatus and appropriate setting for said puzzle figurines in their perpendicular position;

a means for connection at the bottom edge of said base and said frame, securing said frame in its horizontal position on top of said base, said base remains stationery while said means for connection enables said frame to lift releasing said puzzle figurines from their assembled position, said means for connection further secures said frame in its perpendicular position behind said base, altogether said base, said frame, and said means for connection create a holding and display apparatus for said puzzle figurines in their horizontal and perpendicular position.

* * * * *